US005388603A

United States Patent [19]

Bauer et al.

[11] Patent Number: 5,388,603

[45] Date of Patent: Feb. 14, 1995

[54] ELECTRONIC STUNNING TRUNCHEON AND UMBRELLA

[76] Inventors: Paul J. Bauer; Barbara Bauer, both of 322 Canal Walk #374, Indianapolis, Ind. 46202

[21] Appl. No.: 165,481

[22] Filed: Dec. 13, 1993

[51] Int. Cl.[6] ..... A45B 03/00

[52] U.S. Cl. ..... 135/16; 135/19; 42/108

[58] Field of Search ..... 135/16, 18, 19, 34.2; 42/1.08, 1.16, 52, 84; 452/57, 58, 60

[56] References Cited

U.S. PATENT DOCUMENTS

| | | | |
|---|---|---|---|
| 2,861,373 | 11/1958 | Weinert | 42/1.16 X |
| 3,241,259 | 3/1966 | McBride | 42/1.08 |
| 3,730,199 | 5/1973 | Thur | 135/20 |
| 3,803,463 | 4/1974 | Cover | 317/262 |
| 3,819,108 | 6/1974 | Jordan | 231/2 |
| 4,093,969 | 6/1978 | Maynor, Jr. | 361/232 |
| 4,162,515 | 7/1979 | Henderson et al. | 361/232 |
| 4,254,132 | 3/1981 | Kramer | 424/269 |
| 4,489,943 | 12/1984 | Werft | 273/84 |
| 4,819,137 | 4/1989 | Hamilton | 362/102 |
| 4,872,084 | 10/1989 | Dunning et al. | 361/232 |
| 4,962,779 | 10/1990 | Meng | 135/16 |
| 4,968,034 | 11/1990 | Hsieh | 273/84 |
| 5,041,951 | 8/1991 | Fan | 362/102 |
| 5,060,123 | 10/1991 | Arnold | 362/102 |
| 5,086,377 | 2/1992 | Roberts | 362/102 |
| 5,167,247 | 12/1992 | Belmonte | 135/16 |
| 5,282,332 | 2/1994 | Philips | 42/1.08 |

OTHER PUBLICATIONS

Spy Headquarters Product Catalog; 1235 East Northern, Phoenix, AZ 85020 1993 issue, pp. 5 and 6.

*Primary Examiner*—Lanna Mai

[57] ABSTRACT

A multipurpose hand-held personal protection accessory, disguised as a compact umbrella, including an umbrella, truncheon, and electronic stunner. The compact umbrella (11) is housed within nonconductive, lightweight, impact-resistant tubing (12), which has conductive strips (13, 14, and 15) along its outer surface for the discharge of nonlethal shocks produced by a high voltage transformer (21) contained within the tubing.

7 Claims, 4 Drawing Sheets

ELECTRONIC STUNNING TRUNCHEON AND UMBRELLA

BACKGROUND - FIELD OF INVENTION

This invention relates to the umbrella as a hand-held personal protective accessory, specifically a multipurpose device made to function as a truncheon, electronic stunner, or umbrella, while appearing to be a conventional umbrella.

BACKGROUND - DESCRIPTION OF PRIOR ART

It is a well known statistic that crimes against persons have increased in recent years. Accordingly, many people frequently carry, or maintain close at hand, various personal protective devices of a type that may be used to fend off an attacker. Many of these devices are multi-functional.

Prior art is known to include umbrellas in combination with other devices such as cattle prods, gas sprayers, and buzzers. Many of these devices have been disguised as umbrellas in order to mask the offensive capacity of the weapon and to insure readiness by incorporating them into a recognizable hand-held personal accessory.

U.S. Pat. No. 4,093,969 to Maynor, Jr. (1978) describes a conventional umbrella provided with an electric shocking device like those used in cattle prods. Maynor further describes an umbrella which will provide a shock to anyone who grasps the cover of the umbrella between the tip and the handle. However, the Maynor device fails to afford the user any greater protection then a conventional umbrella in the event of an electrical failure. Furthermore, the fragile components of a conventional umbrella are susceptible to damage if the device must be used as a truncheon to fend off an assailant.

U.S. Pat. No. 4,962,779 to Yeong-Ming Meng (1990) describes an umbrella which may be used as a truncheon when retained in its flexible fabric sleeve. Indeed, a fabric sleeve may retain the components of an umbrella, however, its flexibility cannot protect the components from damage when used as a truncheon. Moreover, a flexible containment sleeve allows the dissipation of impact force and therefore limits its effectiveness as a truncheon.

OBJECTS AND ADVANTAGES

Accordingly, several objects and advantages of our present invention are:

(a) to provide positive protection from the elements in the form of an umbrella;

(b) to provide an effective self defense weapon in the form of an electronic stunner;

(c) to provide an effective self defense weapon in the event of an electrical failure in the form of a truncheon;

(d) to provide effective personal protection that is disguised as a common personal accessory;

(e) to provide protection for fragile electronic and umbrella components by containing them within an impact-resistant housing;

(f) to encourage the carrying of personal protection by combining a stunning truncheon with the utility of an attractive, fully functional, compact umbrella;

(g) to provide a means for extending the effective distance beyond that of traditional stun guns, which require the user to be within grasping distance of the human or canine assailant, by placing stunning probes at a distance from the hand of the user, (h) to provide a means to bar the assailant from seizing the weapon by making the exterior surface of the truncheon electronically active and capable of discharging a nonlethal high voltage stunning shock;

(i) to provide additional defense and alarm by presenting an audible and visual high voltage display;

(j) to provide for safe usage of the stunning truncheon by equipping it with a safety switch;

(k) to provide for a means of keeping the stunning truncheon at full charge with a recharging jack;

Further objects and advantages of our invention will become apparent from a consideration of the drawings and ensuing description.

DRAWING FIGURES

REFERENCE NUMERALS IN DRAWINGS

Figure 1:
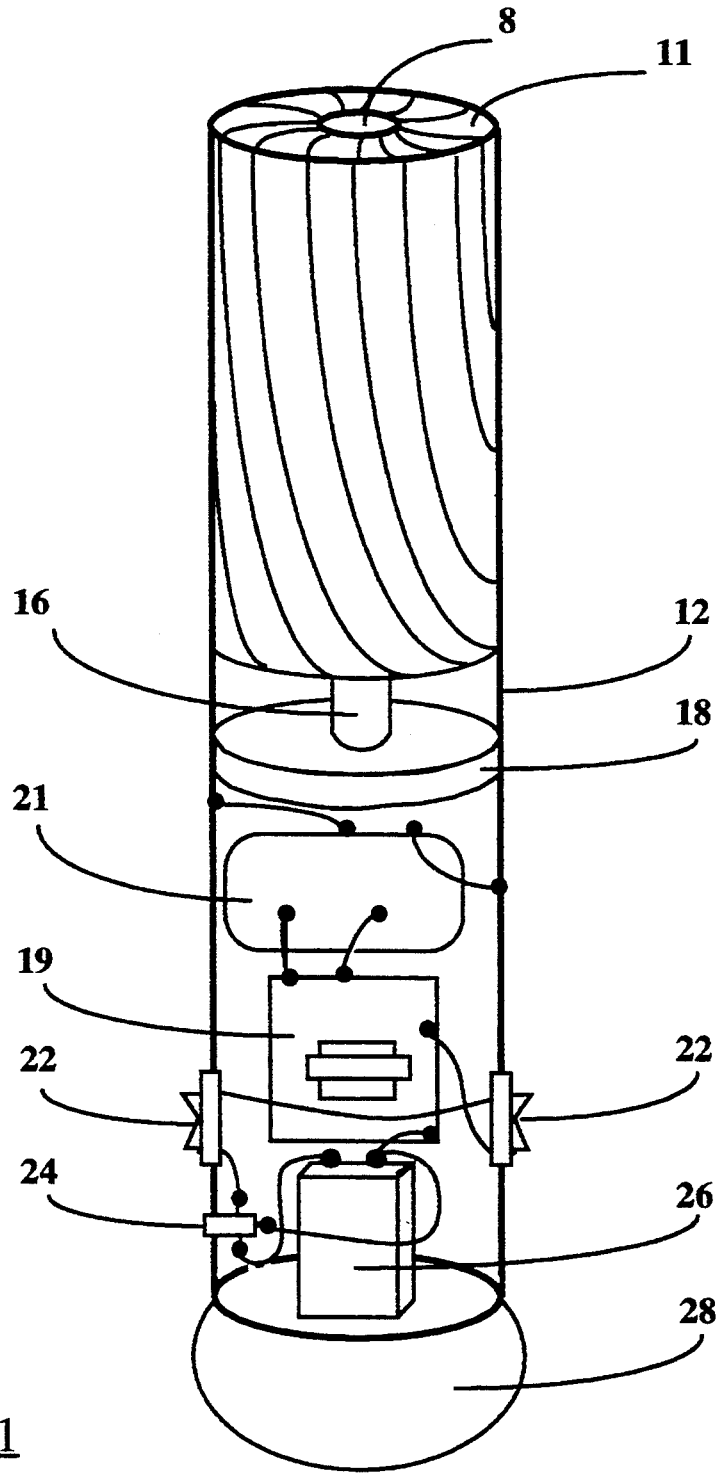
FIG. 1 shows the components of the unsheathed truncheon including the collapsed and stored umbrella.

8 Umbrella tip
9 Pull cord
10 Canopy (open)
11 Canopy (stored)
12 Impact-resistant tubing
13 Positive electrodes
14 Negative electrodes
15 Distal electrodes
16 Telescoping shaft
18 Shaft base
19 Integrated circuit board
21 Step-up transformer
22 Momentary rocker switches
24 Recharging jack
26 Battery
28 Decorative end cap
30 Safety carrying strap
32 Fabric sheath
34 Retaining cord

DESCRIPTION - FIGS. 1 TO 4

Various views of the present invention are illustrated in FIGS. 1 through 4.

FIG. 1 shows a cylindrical truncheon made of nonconductive, impact-resistant tubing 12. In a typical embodiment, the tubing is made of LEXAN TM which is available from General Electric Corp. However, the truncheon can be composed of any other nonconductive, lightweight, rigid material, which can withstand a strong impact without fracturing or collapsing in upon the fragile umbrella mechanism contained within. Other materials that may be substituted include: polyethylene, polypropylene, nylon, vinyl, rubber, various impregnated or laminated fibrous materials, or various plasticized materials.

The truncheon is divided into 2 compartments by an umbrella shaft base 18. The umbrella compartment houses a compact conventional umbrella. The umbrella comprises a canopy 11 and tip 8, a telescoping umbrella shaft 16, and the shaft base 18. The canopy 11 is supported on the conventional telescoping umbrella shaft 16. The shaft 16 is embedded in the shaft base 18. The shaft base 18 is made of any nonconductive material, such as plastic. The shaft base 18 serves to secure the position of the umbrella and forms a moisture barrier between the umbrella compartment and electrical compartment.

The second compartment is the electrical compartment, which contains conventional stun gun components. These comprise an integrated circuit board 19 and step-up transformer 21. The preferred embodiment uses the NOV A XR5000 TM solid state microchip technology stun gun components, available from Guardian Security Products, 21639 N. 14th Avenue, Phoenix, Ariz. However, any nonlethal high voltage electrical discharge source may be substituted.

Also contained in the electrical compartment are a battery 26, switches 22, and a recharging jack 24. The preferred battery 26 is a 9 volt rechargeable nickel cadmium type, however any portable voltage source may be used. The battery 26 is recharged by connection to a voltage source through the recharging jack 24. The recharging jack 24 is mounted within a hole cut through the wall of the tubing 12. In a typical embodiment, the jack 24 is a closed circuit type mini phone jack.

A typical embodiment uses two momentary rocker switches 22 placed in series. However, any series of switches which allow concurrent closure will provide the necessary protection against unintended discharge. The switches 22 are mounted within holes cut through the wall of the tubing 12.

The battery 26 provides a low voltage direct current source of 9 volts and is wired to the integrated circuit board 19 through a series of switches 22. The circuit board 19 converts the low voltage direct current received from the battery 26 to an intermediate level alternating current by use of circuitry similar to that of other commercially produced stun guns based upon U.S. Pat. No. 4,162,515 issued to Henderson in 1979. The circuit board 19 is wired to the step up transformer 21 which multiplies the voltage from the circuit board 19 to approximately 60,000 volts with a current equivalent of about 0.003 amps. The poles of the step-up transformer 21 are wired to external electrodes 13 and 14 (shown in FIG. 3) through two holes in the tubing 12.

A decorative end cap 28 seals the proximal lumen of the tubing 12. In a typical embodiment, the end cap 28 is composed of wood and is press fit into the lumen of the tubing 12. However, the end cap 28 may be made of any impact-resistant material and secured in any fashion which makes it convenient to remove, when/if the battery is replaced.

Figure 2:
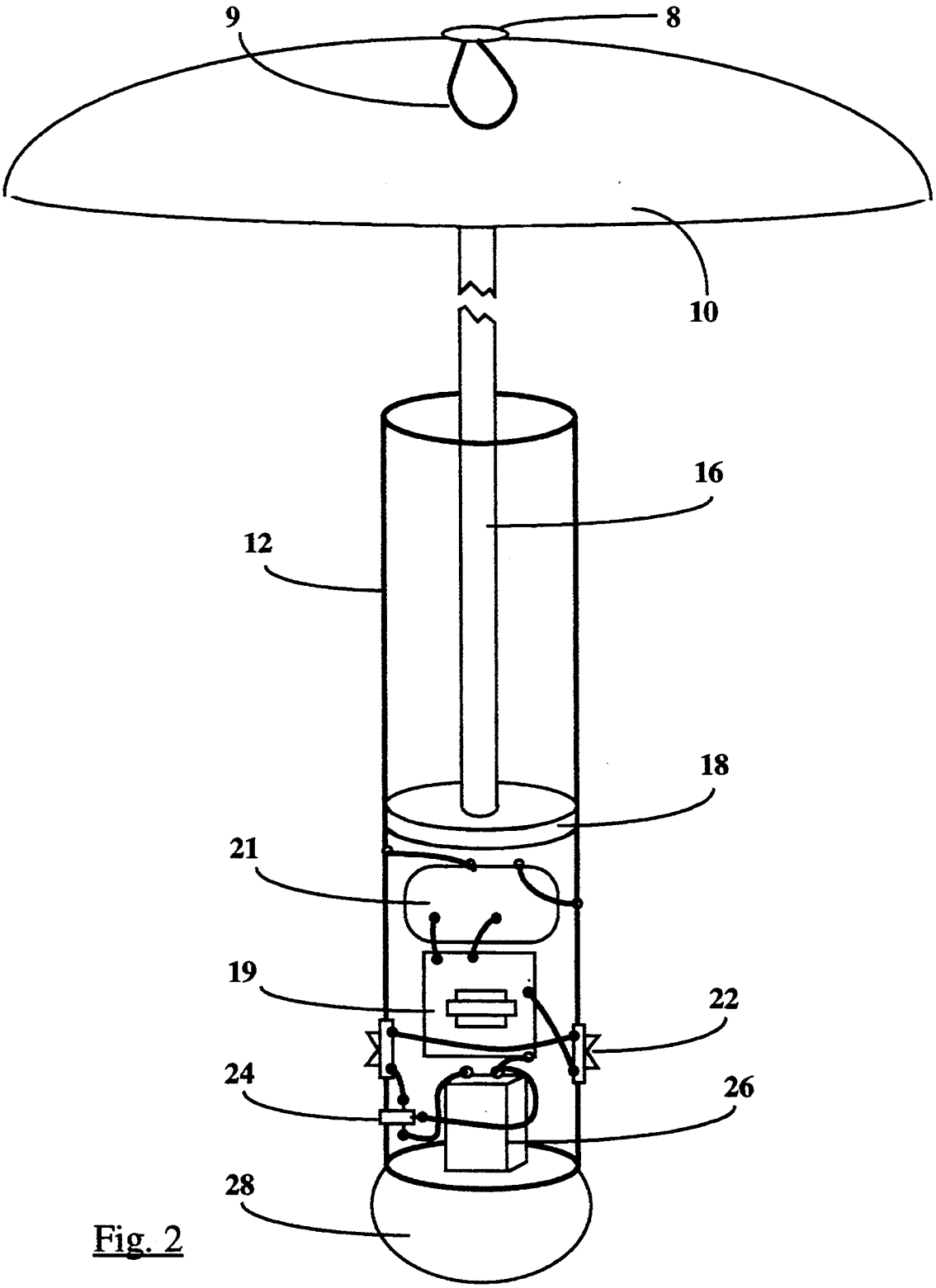
FIG. 2 shows the components of the unsheathed truncheon with the telescoping shaft extended and the canopy open.

FIG. 2 shows the components of truncheon with the shaft 16 fully extended, and the canopy 10 in the open position.

Figure 3:
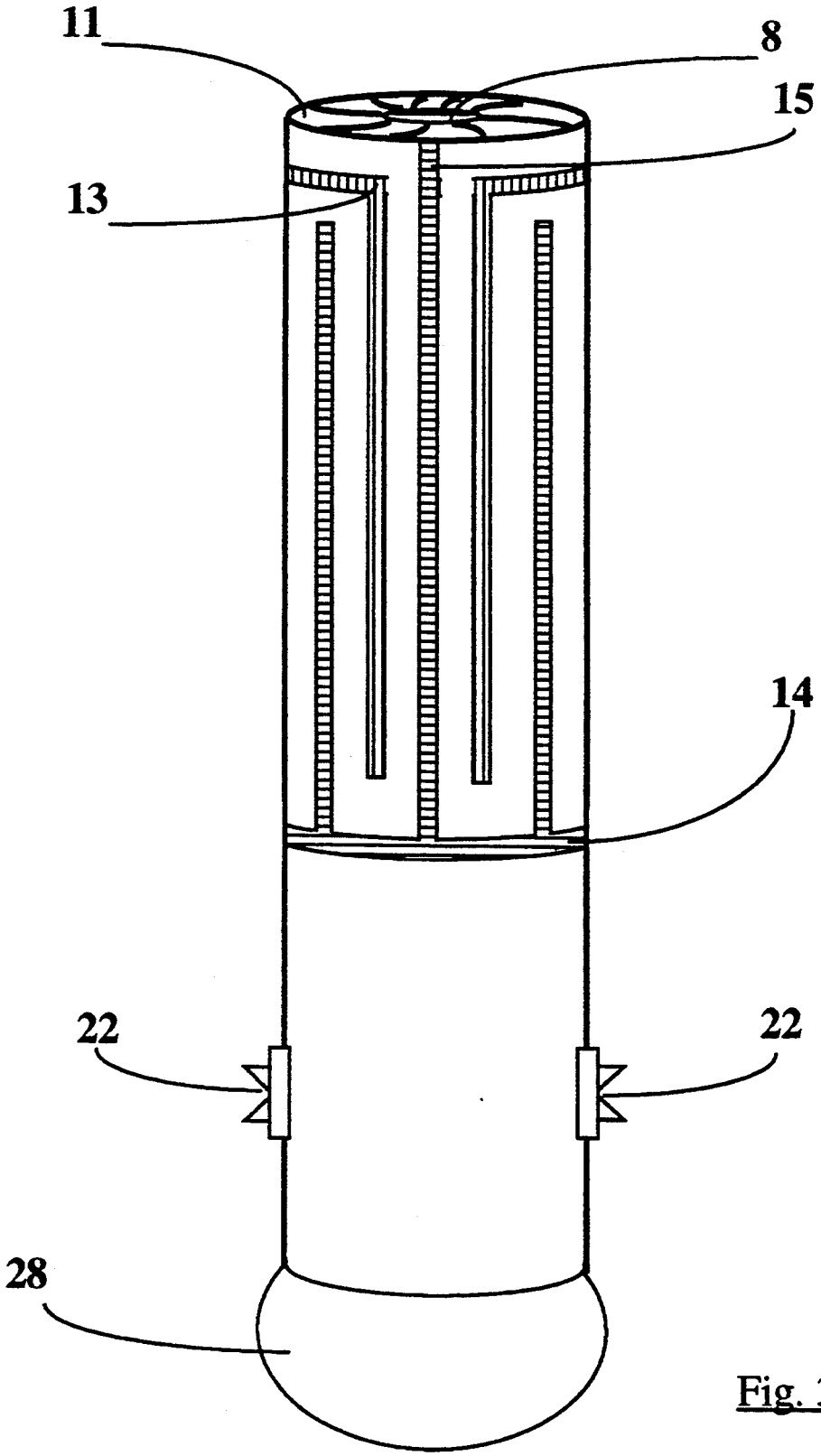
FIG. 3 shows the external view of the unsheathed truncheon with the umbrella canopy stored, and the external electrodes revealed.

FIG. 3 is an external view of the truncheon, with the canopy 11 stored. In a typical embodiment, external electrodes 13 and 14 are made of self adhesive copper tape, and are adherent to the exterior of the tubing 12. However, any conductor may be attached to the exterior of the truncheon. The electrodes 13 and 14 are placed sequentially, alternating negative and positive, along the long axis of the tubing 12. Additionally, positive and negative contacts are created at the distal end of the tubing by extending the distal electrodes 15 onto the lip of the distal end of the tubing 12.

Figure 4:
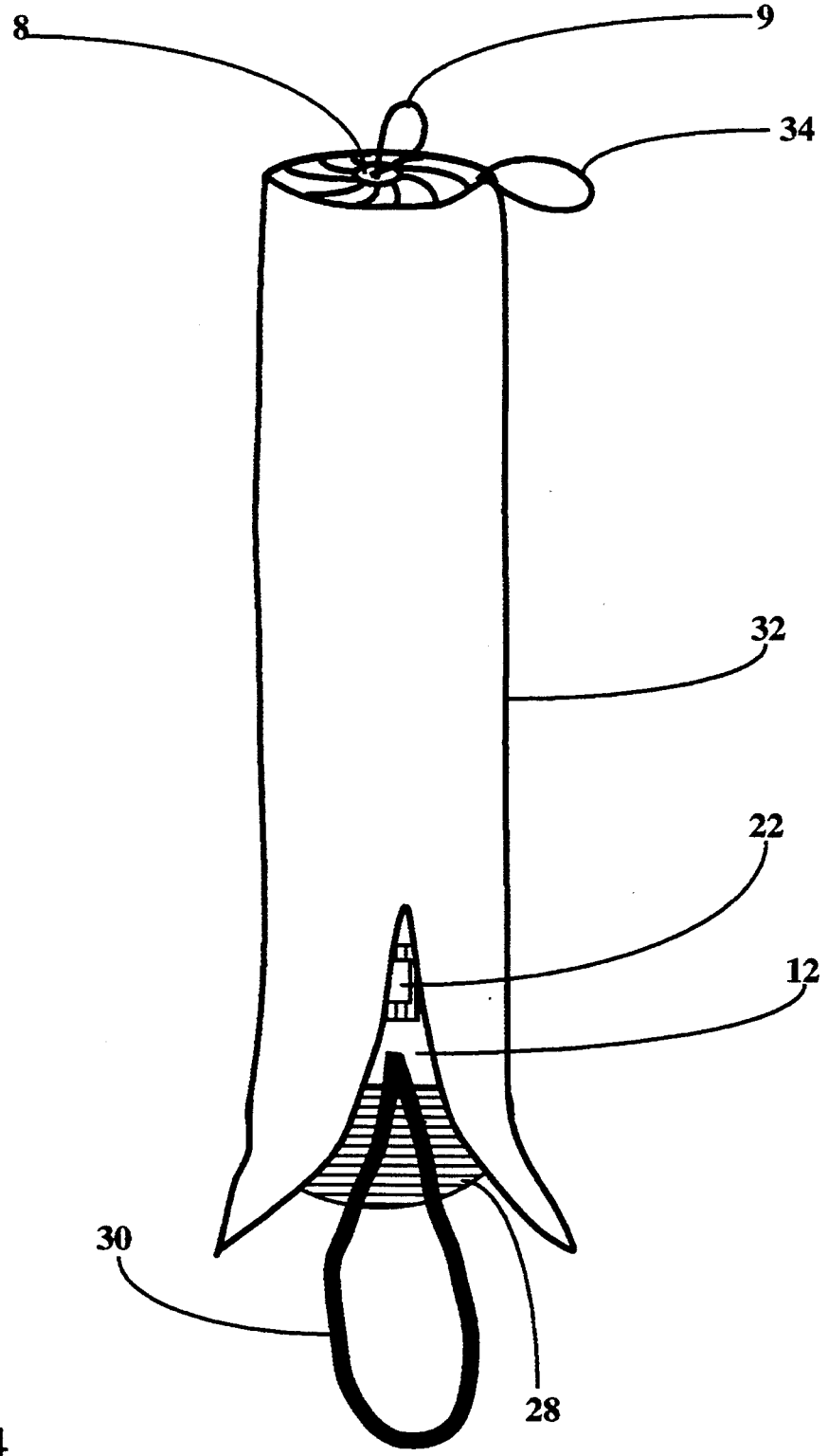
FIG. 4 shows the truncheon with active electrodes concealed by fabric sheath and umbrella canopy stored.

FIG. 4 shows a perspective view of the sheathed truncheon. A fabric sheath 32 covers and conceals the truncheon, simulating a conventional umbrella and cover. In a typical embodiment, the fabric sheath 32 is substantially similar in material and color to the stored umbrella canopy 11. The sheath 32 is bonded to the internal surface of the tubing 12 at the distal end. Also shown is a pull cord 9, safety carrying strap 30, and a retaining cord 34. In a typical embodiment, the pull cord 9, carrying strap 30, and retaining cord 34 are made of synthetic cord. The safety strap 30 and retaining cord 34 are attached by passing them through small holes cut in the tubing 12, and knotting them within the lumen of the tubing 12. The pull cord 9 is attached by passing it through a hole cut in the umbrella tip 8.

OPERATION - FIGS. 1 TO 4

The present invention is a multipurpose device adapted to function as an umbrella, truncheon and electronic stunner. The manner of use depends upon the function required by the user.

To use the umbrella function, the user removes the retaining cord 34 from around the umbrella tip 8 (see FIG. 4). Then, referring to FIGS. 1 through 3, the user grasps the truncheon handle, which is the area between decorative end cap 28 and rocker switches 22. Holding the truncheon with umbrella tip up, the user smartly moves the tip through a 180 degree arc, stopping sharply perpendicular to the ground. Centrifugal force easily propels the umbrella tip 8 several inches or more beyond the tubing 12. This allows the user to grasp the umbrella 11 and completely extend the telescoping shaft 16. Alternatively, the user may remove the retaining cord 34 and grasp the pull cord 9 to draw the umbrella from the tubing 12 (see FIG. 1 or FIG. 4). The canopy is then opened in the conventional manner by sliding the umbrella's opening mechanism to the locked position. The invention is then ready for use as a conventional umbrella.

To store the umbrella, the user releases the lock of the conventional umbrella mechanism to collapse the canopy 10. The user then folds and wraps the umbrella canopy, reducing it to its smallest diameter in the conventional manner. Then, while grasping the folded canopy with one hand and the truncheon in the other, the user guides the canopy 10 into the lumen of the tube 12. To secure the stored umbrella canopy 11, the user loops the retaining cord 34 around the umbrella tip 8.

To use the truncheon, the user places his hand through the safety carrying strap 30, and grasps the truncheon handle. The purpose of the safety strap 30 is to eliminate the chance that the truncheon can be taken away from the user, or dropped while striking. The user may then defend himself in the same manner as if he were using a billy club or other bat-like object. The size and weight of the truncheon allows it to be wielded easily and effectively in close quarters.

To use the device as an electronic stunner, the user grasps the handle in the same manner as he would for use as a truncheon. To discharge the stunning baton for the purpose of a warning display, the user simply grasps the handle and depresses both switches 22 simultaneously. Depressing both switches causes a high voltage discharge to pass through the air from one electrode to another. The high voltage discharge is accompanied by a visible electrical arcing and an audible crackling sound. The arcing typically occurs randomly across the surface of the fabric sheath. The display is sufficient to warn off all but the most persistent attackers.

If the attacker persists, the user can simply touch the attacker with the truncheon while depressing the switches. When the resistance between the truncheon electrodes and the body of the attacker is less than that of the spark gap, a circuit is created through the body of the attacker. Touching the attacker with any part of the active area of the truncheon, while depressing the switches, delivers a nonlethal high voltage jolt. When contacted with the active electrodes the attacker experiences varying degrees of discomfort from muscle contractions to complete immobilization, depending upon the length of contact. Stunning technology has long been established as a safe and effective means for the control of crowds and animals.

It should be emphasized that, when functioning as either a truncheon or electronic stunner, the device remains disguised as, and is substantially indistinguishable from, a conventional, covered, compact umbrella (as shown in FIG. 4). The disguise gives the user the advantage of surprise. Furthermore, the active area of the truncheon extends circumferentially a safe distance beyond the switches 22 to the distal electrodes 15 at the end of the truncheon (see FIG. 3). The large electrically active area of the truncheon bars the attacker from seizing the truncheon and wresting it from the user.

The length of the truncheon gives the user a safety advantage over conventional annular stun guns, by extending the effective distance between the attacker and the user. An additional safety factor is the inclusion of a double switch system that eliminates the possibility of accidental discharge. A recharging jack 24 has been incorporated to insure maximum battery output at all times. A typical embodiment allows the user to keep the device recharged in his/her automobile with use of a 9 volt converter.

While the typical embodiment uses a rechargeable 9 volt nicad battery, the user may choose to use a 9 volt alkaline battery. The end cap 28 may be removed to obtain access to the battery compartment. In addition, other embodiments may include, but are not limited to, different combinations of switches, electrical components, covers, straps and retaining mechanisms.

SUMMARY, RAMIFICATIONS, AND SCOPE

Accordingly, the reader will see that this invention is a multipurpose, personal protective accessory that provides protection from the elements in the form of an umbrella, and from human or animal assault, in the form of an electronic stunning truncheon. The device has been specifically designed to be economical to manufacture and simple to operate. In addition, the outward appearance of a common, attractive, personal accessory encourages the carrying of personal protection, and gives the user the advantage of surprise when faced with an assailant. The weapon's impact-resistance, size and mass are mainly responsible for its effectiveness as a truncheon. The weapon's length extends the effective distance beyond that of ordinary stun guns, and its electronically active exterior bars the assailant from seizing the weapon. Further, the audible and visual warning display provides additional defense and alarm. Protection is further afforded the user with various safety switches, straps, and recharging jacks.

Although the description above contains many specifications, these should not be construed as limiting the scope of the invention, but as merely providing illustrations of some of the presently preferred embodiments of this invention. Many other variations are possible. Thus the scope of the invention should be determined by the appended claims and their legal equivalent, rather than by the examples given.

We claim:

1. A hand-held, personal protective accessory comprising:

a) a compact umbrella including a telescoping shaft having a shaft base at one end and a canopy at an opposite end, said canopy having an umbrella tip;

b) a truncheon formed of nonconductive, lightweight, rigid, impact-resistant tubing, wherein said umbrella being stored within said tubing, said tubing having a proximal end and a distal end;

c) an electronic stunner including an integrated circuit board, step-up transformer, switches, external positive and negative electrodes, wherein said board is connected to said transformer; said board is further connected to said switches; said transformer being connected to said electrodes; said board and transformer being stored within said tubing; said switches pass through said tubing, and said electrodes are placed sequentially, alternating negative and positive along the axis of the external surface of said tubing with two of said electrodes extending onto said distal end of said tubing;

d) said stunner, truncheon, and umbrella being conjoined so as to create a personal protective accessory;

e) means disguising said personal protective accessory so as to substantially appear to be a compact umbrella by sheathing said personal protective accessory with a fabric cover of approximately the same material and color of said canopy, and said tubing is sealed and finished with a decorative end knob to complete the illusion of a compact umbrella.

2. A hand-held, personal protective accessory of claim 1, further including a pull cord attached to said umbrella tip, whereby said canopy may be drawn from within said tubing.

3. A hand-held, personal protective accessory of claim 1 wherein said switches are momentary rocker switches placed in series, so as to act as a safety mechanism, allowing concurrent closure to activate said stunner.

4. A hand-held personal protective accessory of claim 1, further including a 9 volt rechargeable nickel cadmium battery stored within said tubing said battery is connected to said board through said switches.

5. A hand-held personal protective accessory of claim 4, further including a closed circuit type mini phone jack for the recharging of, and keeping said battery at full charge.

6. A hand-held personal protective accessory of claim 1, further including a synthetic cord safety carrying strap attached to the proximal end of said tubing.

7. A hand-held personal protective accessory of claim 1, further including a synthetic retaining cord, passed through the distal end of said tubing, whereby said umbrella canopy is retained within said tubing by looping said retaining cord around said umbrella tip.

* * * * *